US005397228A

United States Patent [19]

Metten

[11] Patent Number: 5,397,228

[45] Date of Patent: Mar. 14, 1995

[54] METHOD AND DEVICE FOR THE FABRICATION OF PERFORATED BLOCKS

[75] Inventor: Josef Metten, Bergisch Gladbach, Germany

[73] Assignee: Metten Produktions-und Handels-GmbH, Overath, Germany

[21] Appl. No.: 3,248

[22] Filed: Jan. 11, 1993

[30] Foreign Application Priority Data

Jan. 13, 1992 [DE] Germany ..... 42 00 602.3

[51] Int. Cl.[6] ..... B28B 1/44; B28B 3/02; B28B 7/18

[52] U.S. Cl. ..... 425/290; 264/156; 425/308; 425/398; 425/414; 425/422; 425/436 RM; 425/443; 425/454; 425/DIG. 37

[58] Field of Search ..... 425/290, 308, 414, 398, 425/422, 436 R, 436 RM, 454, 443, DIG. 37; 264/154, 155, 156, 294; 249/66.1

[56] References Cited

U.S. PATENT DOCUMENTS

| | | | |
|---|---|---|---|
| 345,272 | 7/1886 | Brown | 425/290 |
| 1,608,727 | 11/1926 | Dickey | 264/156 |
| 2,091,973 | 9/1937 | Fessler et al. | 425/290 |
| 2,611,434 | 9/1952 | Mugler | 425/290 |
| 3,077,658 | 2/1963 | Wharton | 264/156 |
| 3,891,367 | 6/1975 | Signora | 425/443 |
| 3,920,369 | 11/1975 | Boehringer et al. | 425/454 |
| 3,957,409 | 5/1976 | Grosch | 425/290 |
| 4,057,383 | 11/1977 | Bettonica | 425/422 |
| 4,063,866 | 12/1977 | Lurbiecki | 425/443 |
| 4,525,135 | 6/1985 | Forestier et al. | 425/290 |
| 4,725,214 | 2/1988 | Piazza et al. | 425/454 |

FOREIGN PATENT DOCUMENTS

| | | | |
|---|---|---|---|
| 1534273 | 6/1969 | Germany . | |
| 2325165 | 11/1974 | Germany . | |
| 225590 | 6/1962 | Netherlands . | |
| 159106 | 2/1921 | United Kingdom | 425/290 |
| 307182 | 3/1929 | United Kingdom | 425/290 |
| 866707 | 4/1961 | United Kingdom | 425/290 |
| 1294617 | 3/1987 | U.S.S.R. | 425/443 |
| 1430280 | 10/1988 | U.S.S.R. . | |

*Primary Examiner*—Khanh Nguyen
*Attorney, Agent, or Firm*—Charles L. Schwab

[57] ABSTRACT

Device for the fabrication of concrete blocks having thin through holes for the drainage of water (perforated blocks), the fabrication taking place in at least one mold filled with concrete, which mold is supported on a mold table, and at least one male die for the compaction of the concrete. In order to create the thin holes, core pins are arranged in the region of the male dies or of the mold table or of the mold, which core pins are introduced inside the mold before the compaction of the concrete. Afterward, the concrete is compacted, the core pins are removed from the region of the mold, the compacted concrete blocks are completely demolded, and the concrete blocks are cured.

7 Claims, 6 Drawing Sheets

10
15
11
10
6
3
5
17
4
4
17
14
6
3
2
13
12
13
1
1

METHOD AND DEVICE FOR THE FABRICATION OF PERFORATED BLOCKS

TECHNICAL FIELD

This invention relates to a method and a device for the fabrication of concrete blocks having thin through holes for the drainage of water (perforated blocks), in particular paving stones of various formats and sizes, the fabrication taking place in at least one mold filled with concrete, which mold is supported on a mold table, and at least one male die, corresponding to the mold as well as the block surface, for the compaction of the concrete, and the concrete blocks then being cured.

BACKGROUND OF THE INVENTION

A method and a device for the fabrication of concrete blocks, in particular paving stones, is known, for example, by means of European Patent Application 0 319 972. In accordance with this European Patent Application, however, concrete blocks having special surface structure are fabricated, but not concrete blocks having through holes.

It is therefore an object of the present invention to modify known methods and devices in such fashion that concrete blocks, in particular paving stones, of various formats and sizes having thin through holes for water drainage (perforated blocks) can be fabricated. It is intended that both concrete blocks having smooth surface and those having rough or roughened surface can be fabricated. This object of the invention is achieved by virtue of the fact that core pins are arranged in the region of the male dies or of the mold table or on the mold; that the core pins are introduced at least partially inside the mold before the compaction of the concrete; that the concrete is then compacted by means of an advance of the male die; that the core pins or the compacted concrete blocks are then at least partially removed from the region of the mold or of the core pins, and afterward the male dies and, to the extent that this has not already happened, the core pins are retracted from the region of the compacted concrete blocks or the compacted concrete blocks are raised out of the region of the core pins and the concrete blocks are completely removed from the mold.

The core pins may be mounted directly or indirectly on the male die whereby they are advanced and retracted with said male die, so that the core pins initially penetrate into the still-uncompacted soft concrete and, indeed, penetrate farther and farther until the male die comes into contact with the upper face of the still-soft concrete and compacts the same, said pins extending to the mold table, so that by this means thin through holes are molded into the compacted concrete blocks. Afterward, the mold is preferably raised first, then the male dies with the pins, so that complete molded concrete blocks are present. So that the pins can be withdrawn from the still-soft, uncured concrete block without damaging the same, it is advantageous if the pins are designed in conical form.

There also exists, however, the possibility that the core pins are mounted not on the male die or a die plate but on the mold. This can be accomplished, for example, via at least one web that is mounted on the mold and to which the core pins in turn are attached by one end. They then project into the mold and, indeed, as far as the mold table. In this case, the concrete is charged into this so-designed mold and then compacted with a male die that, in correspondence with the number of webs, consists of a plurality of end faces adapted to the webs. The mold is then raised, and afterward the male die, so that the desired concrete blocks having thin holes are again present.

Finally, there also exists another possibility that the core pins are mounted on the mold table and their free ends point in the direction of the male die or die plate. In this case, the length of the core pins can be adjusted so that they, in combination with the quantity of concrete charged, just come into contact with said concrete after compaction by means of the male die. Openings or recesses can, however, also be made in the male die so that the core pins in the final compacted condition extend into said openings or recesses. If the core pins are mounted on the mold table, then for demolding the mold is preferably raised simultaneously together with male dies or die plate, the still-soft compacted concrete blocks being assumed to be lifted along with said mold, so that they are raised from the mold table and the core pins. Afterward, after removal of the mold table with the core pins, or by means of setting down next to the mold table, the concrete blocks are pressed out of the mold in usual fashion, and indeed by means of raising the mold or depressing the male die. Also in this case it is advantageous if the core pins are designed in conical form. The molds can also be designed in slightly conical form, that is, narrowing slightly toward the mold table, so that the still-soft concrete blocks better adhere in the mold and are raised along with the same.

In development of the invention, it is proposed that a movable component having core pins is arranged in the region of the male dies or of the mold table; that the core pins are introduced at least partially into the concrete inside the mold before the compaction of the concrete; that the concrete is next compacted by means of an advance of the male dies; that the core pins are then retracted at least partially out of the region of the mold and the male dies and, to the extent that this has not yet happened, the core pins are afterward retracted out of the region of the concrete blocks and the concrete blocks are demolded. The expression "at least partially" in connection with the movement of the core pins both into the concrete-filled mold and out of the mold was selected because, depending on the development of the device, it is possible in accordance with the invention either to move the core pins independently of the male die in such fashion that the core pins are completely introduced into the concrete and the concrete is then compacted by means of the male die, and that the core pins are then again completely removed from the region of the mold, the male die afterward being retracted or raised and the concrete blocks demolded. It is also, however, possible in accordance with the invention to couple the movement of the core pins and the movement of the male die together, at least intermittently or partially, in such fashion that the core pins initially are pushed only a certain depth into the concrete inside the mold and are then advanced together with the male die, and conversely initially lifted out of the compacted concrete only to the extent that a raising together with the male die is possible without damage to the still-soft compacted concrete blocks. The last procedure is, in particular, possible without problems if the core pins are designed in conical form.

In development of the method, the component on which the core pins are mounted is advantageously supported and guided outside the male die. The core pins are introduced into the concrete through openings in the male die as far as the mold table.

The method can, however, also be performed in such fashion that the component is supported and guided on the mold table and that the core pins are introduced into the concrete through openings in the mold table as far as the male die. Supported and guided on the mold table means that the component can be both arranged in a larger-volume mold table and also supported beneath the mold table.

In the case of a device for the performance of the method for the fabrication of concrete blocks having thin through holes for water drainage (perforated blocks), it is proposed that core pins are arranged in the region of the male dies or of the mold table or of the mold, which core pins are arranged inside the compaction space at least during the compaction of the concrete by means of the male dies. These are the basic forms of the device by means of which, with slight modifications, concrete blocks having thin holes can be fabricated on known devices. Depending on the design, the core pins, because mounted on the male dies, are inserted into the soft concrete and again withdrawn therefrom simultaneously with the raising and lowering of the male dies, or said core pins, by virtue of arrangement on the mold or on the mold table, are located in the cavity before the concrete is charged and are withdrawn after compaction of the concrete blocks.

In further development of the device, it is proposed that the male dies exhibit openings; that core pins are arranged preferably on the center line of the openings, which core pins are mounted on at least one component; that the component is arranged on the side of the male die opposite to the mold and is at least partially displaceable in the direction of motion of the male die, independently of said male die; and that the displacement path of the component is designed such that the ends of the core pins, on the one hand, extend to the mold table in the advanced position of the male die and, on the other hand, extend to above the surface of the concrete in the retracted position of the male die. The movement of the component having the core pins can be both dependent on and independent of the male die, for example can be effected by means of hydraulics or pneumatic cylinders or mechanically/electrically by means of electrically actuated spindles. In the case of a solution in which the component having the core pins is moved in completely independent fashion, one or a plurality of adjusting devices can engage a machine frame independently of the male die and its connecting rod. The adjusting device or devices can, however, also engage the male die or a component connected to the male die. The adjusting device can also be designed to operate in simple fashion and can be in effective connection with springs that exert opposing forces.

A simple solution also consists in that the components supporting the core pins are mounted on a connecting rod or connecting pipe or, depending on size, can also be mounted on a plurality of connecting rods and connecting pipes of the machine. The connecting rods or connecting pipes are the structural elements that ordinarily raise and lower the male die or male dies or die plate and compact the concrete. The component or components that support the core pins can advantageously be rigidly mounted on these connecting rods and the male dies for compaction can be elastically supported, inside stops, against these connecting rods. In this case, the core pins therefore initially penetrate at least partially into the concrete until the male die is in contact with the concrete, and then penetrate further as far as the mold table, the male die then yielding in elastic fashion and accomplishing a complete compaction of the concrete only at the end, via the stop. In the reverse motion, the core pins are raised first, the male die or male dies still exerting a residual pressure on the concrete block via the springs, the core pins and the male dies afterward being raised until they are supported above the surface of the concrete blocks and the latter can be removed.

Because the mold is also advantageously raised for the demolding of the concrete blocks, the mold or the component having the core pins can exhibit lugs or projections by means of which the mold is raised at least partway when said component is raised. This can advantageously happen on such a partial path or at such a time that the male dies are still exerting a residual pressure on the concrete blocks, so that the shear force between the mold and the soft concrete block is overcome.

So that grooves can be molded into the bottom of the molded blocks in combination with the holes, the mold table or a drawing sheet arranged on the mold table exhibits strips that exhibit a half-round, cornered, or knife-edge-shaped external contour, corresponding to the desired groove. The strips exhibit openings or longitudinal slots, which are adapted to the core pins or the cross sections of the core pins, so that the latter can extend into said strips. By this means, the core pins have a free space in which they attain, at various heights, such a final position that the male die or male dies can compact the concrete uniformly and without hindrance. This is significant because it cannot be insured that the quantity and density of concrete charged into the mole is always the same. Preferably, the strips are designed hollow and the drawing sheet or the mold table exhibits openings that are in effective connection with the voids. By this means, concrete particles pressed by the core pins into the voids of the strips can again escape.

Because, depending on the design of the molding machine, the drawing sheet is pulled out from under the concrete blocks before said concrete blocks are demolded, so that the concrete blocks come to lie on the mold table or a board, it is advantageous if the longitudinal axes of the strips are oriented parallel to the direction of motion of the drawing sheet, so that the latter can be pulled out from under the concrete blocks without further preparations. If longitudinal slots are arranged in the strips, then the core pins can initially remain in the compacted, still-soft concrete blocks until the strips have been pulled out from under the concrete blocks. By this means, the holes are not clogged or closed by means of the movement of the strips.

As already stated in connection with the method, the device for the performance of the method can also be designed such that the mold table exhibit openings; that core pins are arranged preferably on the center line of the openings, which core pins are mounted on at least one component; that the component is arranged on or in the mold table on the side opposite the mold and is displaceable toward and away from the male die; and that the displacement path of the component is designed such that the end of the core pins, on the one hand, extend to the male die in its lowered position and, on the other hand, extend into openings inside the external surface of the mold table facing the mold or the strips arranged on the mold table or drawing sheet to above the surface of the concrete in the retracted position of the male die. The male dies can also exhibit openings, and the displacement path of the components can be designed such that the ends of the core pins extent into the latter. For the acceptance of the component or components, the mold table or the drawing sheet can be designed in double-wall fashion, and the component can accommodate adjustment devices, springs, and the like. The adjustment devices and/or springs can, however, also be supported outside the mold table or the drawing sheet. In the device last describes, the charging and compaction of the concrete blocks takes place in the known fashion and with the known male dies, while the fabrication of the holes in the concrete blocks takes place by means of core pins, which are inserted from the mold table after the charging of the molds with concrete. In the case of the embodiment having core pins in the region of the mold table, however, the core pins can also by introduced into the mold already before the mold is charged with concrete, the charging and compaction then taking place afterward.

How the method is performed and how the device is designed, that is, whether the core pins are mounted on the male die, on the mold or the mold table, or whether the core pins are introduced into the concrete from the side of the male die or from the mold table, depends on how this can be most simply designed from case to case and what preferences are assigned greatest weight.

It should further be pointed out that the cross section of the core pins can be arbitrary. Initially, it is thought to design said cross section round. It can, however, also be designed oval or square or rectangular. A cross shape having narrow webs can also be advantageous. How the cross section of the core pins is designed is less a question of the fabrication method or of the design of the device than a question of how the cross section of the openings in the perforated blocks should be in the finished condition and what quantities of water are to be drained away.

BRIEF DESCRIPTION OF THE DRAWINGS

For the further explanation of the invention, reference is made to the Drawings, in which several embodiments of the invention are illustrated in simplified form.

DETAILED DESCRIPTION OF THE DRAWINGS

Figure 1:
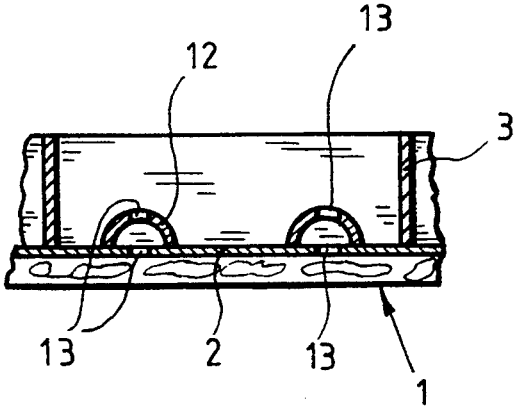
FIG. 1 shows a section through a partial view of a mold with mold table in the empty condition.
Figure 2:
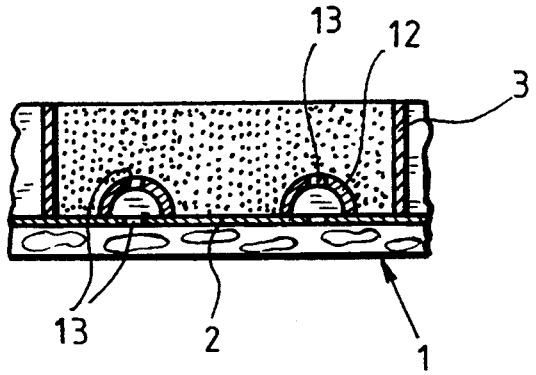
FIG. 2 shows a section through the mold with mold table in accordance with FIG. 2, but in the filled condition.

In FIGS. 1 to 12, where individually illustrated, the number 1 denotes a mold table on which a drawing sheet 2 is supported. On the drawing sheet 2, a mold 3 is arranged, which mold can be raised and lowered independently of the mold table 1. Both the mold table 1 with drawing sheet 2 and also the mold 3 usually exhibit such a size that a large number of cavities are formed, so that a large number of concrete blocks can be fabricated simultaneously. The number 4 denotes a male die, which is mounted on a connecting rod 5, which in turn is braced on one or a plurality of other components, for example a die plate, so that a plurality of male dies corresponding to the size of the mold are provided. Furthermore, the number 6 denotes core pins, which, as shown in FIGS. 4 to 7 and 9 to 10, are mounted on a component 10 in such fashion that a plurality of core pins, for example four or six, are provided for each concrete block.

Figure 3:
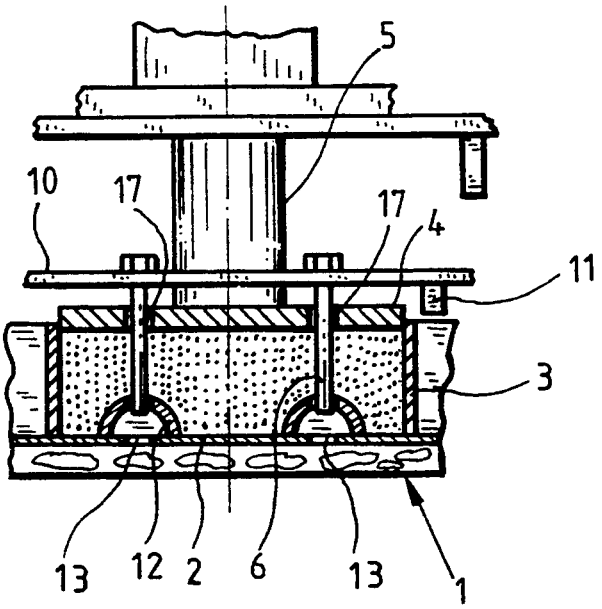
FIG. 3 shows a section in accordance with FIG. 2 in which, however, a male die having a die rod and a component having core pins are additionally illustrated, in the lowered condition.
Figure 5:
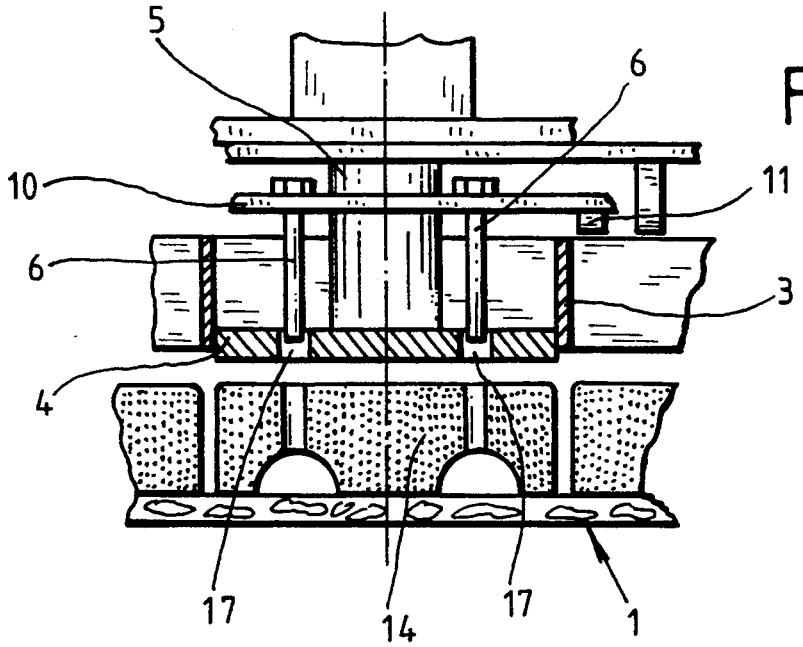
FIG. 5 shows a device in accordance with FIG. 4, in which the male die and the mold is also raised and a drawing sheet having strips, supported on the mold table, is removed.
Figures 6, 7:
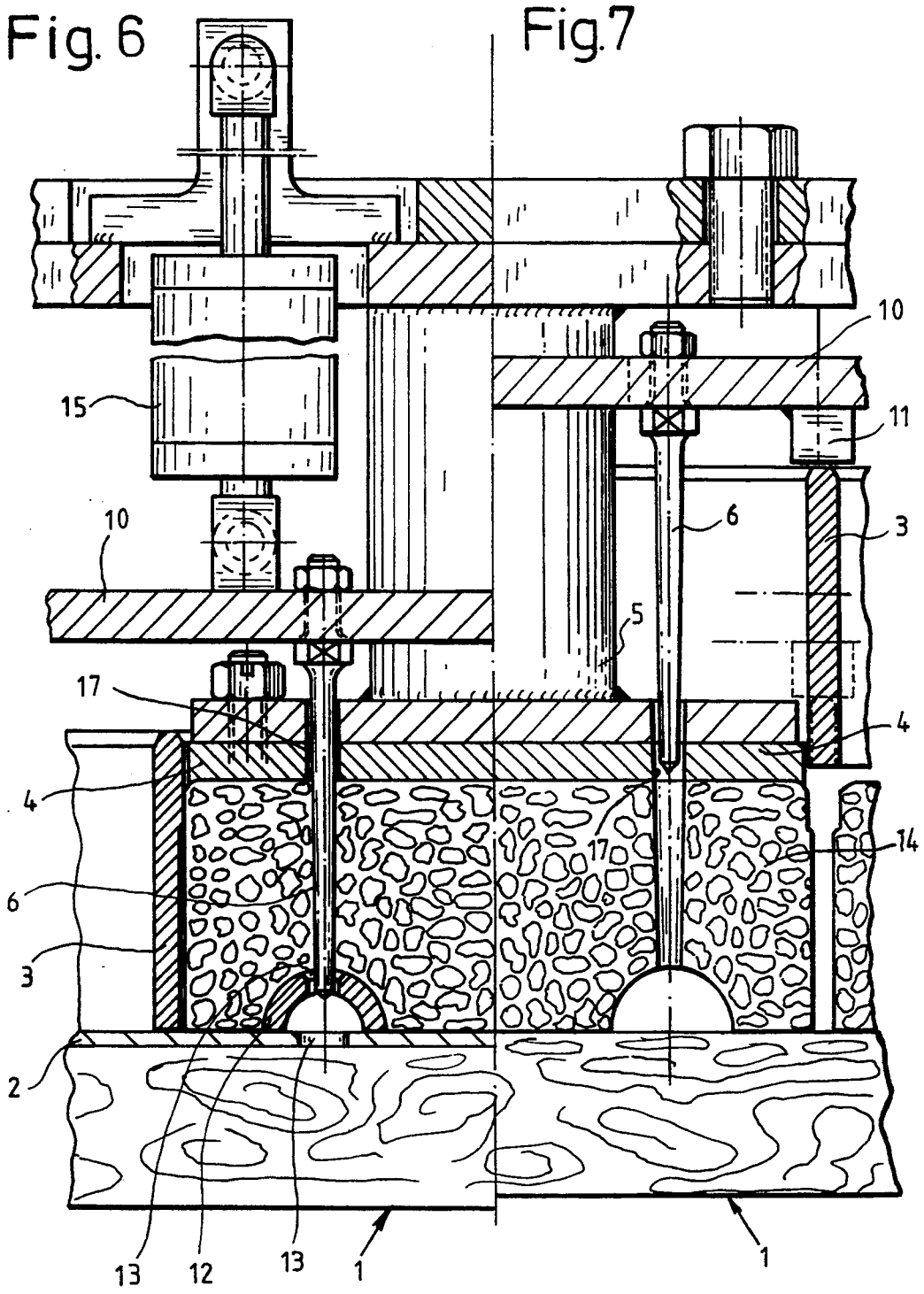
FIG. 6 shows a device corresponding to FIG. 3 at an enlarged scale, which device is embodied in more detail.
FIG. 7 shows a device in accordance with FIG. 4, but at an enlarged scale.

As can be seen from, in particular, FIGS. 3, 5 and 7, stops 11 can be placed on the component 10 so that said stops come into contact with the mold 3 when the latter is raised, and the mold 3 raises the component 10 and thus the core pins 6.

As can further be seen from FIGS. 1 to 4, 6 and 9 and 12, strips 12 are provided on the drawing sheet, which strips exhibit openings 13 for the core pins 6. The openings 13 are adapted in their size to the core pins 6, so that the latter are guided in the strips 12. As shown in FIGS. 1 to 4, 6 and 12, the strips are designed hollow and are in effective connection with openings in the drawing sheet 2, so that concrete material accumulating in the strips can escape.

Figure 4:
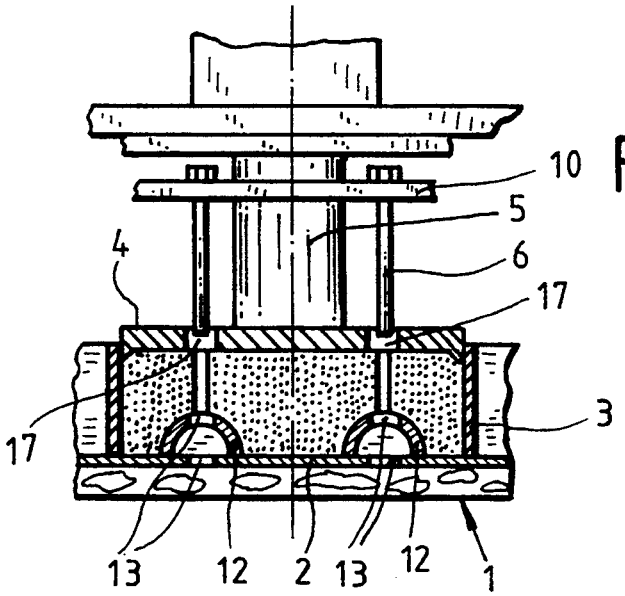
FIG. 4 shows a device for the fabrication of perforated blocks in accordance with FIG. 3, in which, however, the component having the core pins is raised.

After compaction of the wet concrete in accordance with FIG. 3, the core pins 6 are withdrawn from the soft concrete as shown in FIG. 4 or, as shown in FIGS. 5 and 7, the mold 3 and, via the stops 11, the component 10 having the core pins 6 is raised, so that finished molded but still-soft concrete blocks 14 are present as shown in FIGS. 5 and 7, which concrete blocks can then be cured after removal from the machine.

As explained in the general description, the core pins 6 can be raised and lowered independently of the male dies 4 or of the mold 3. They can, however, also be moved via the component 10 in the direction onto the mold table 1, by means of spring force or also by means of a mechanical, hydraulic or pneumatic device, in the direction onto the mold table 1 and then, by means of raising the mold 3, raised via the stops 14. As can be seen from FIG. 6, however, the component 10 can also be advanced and retracted relative to the die plate via an adjustment device 15, which engages, for example, the die plate.

Figure 8:
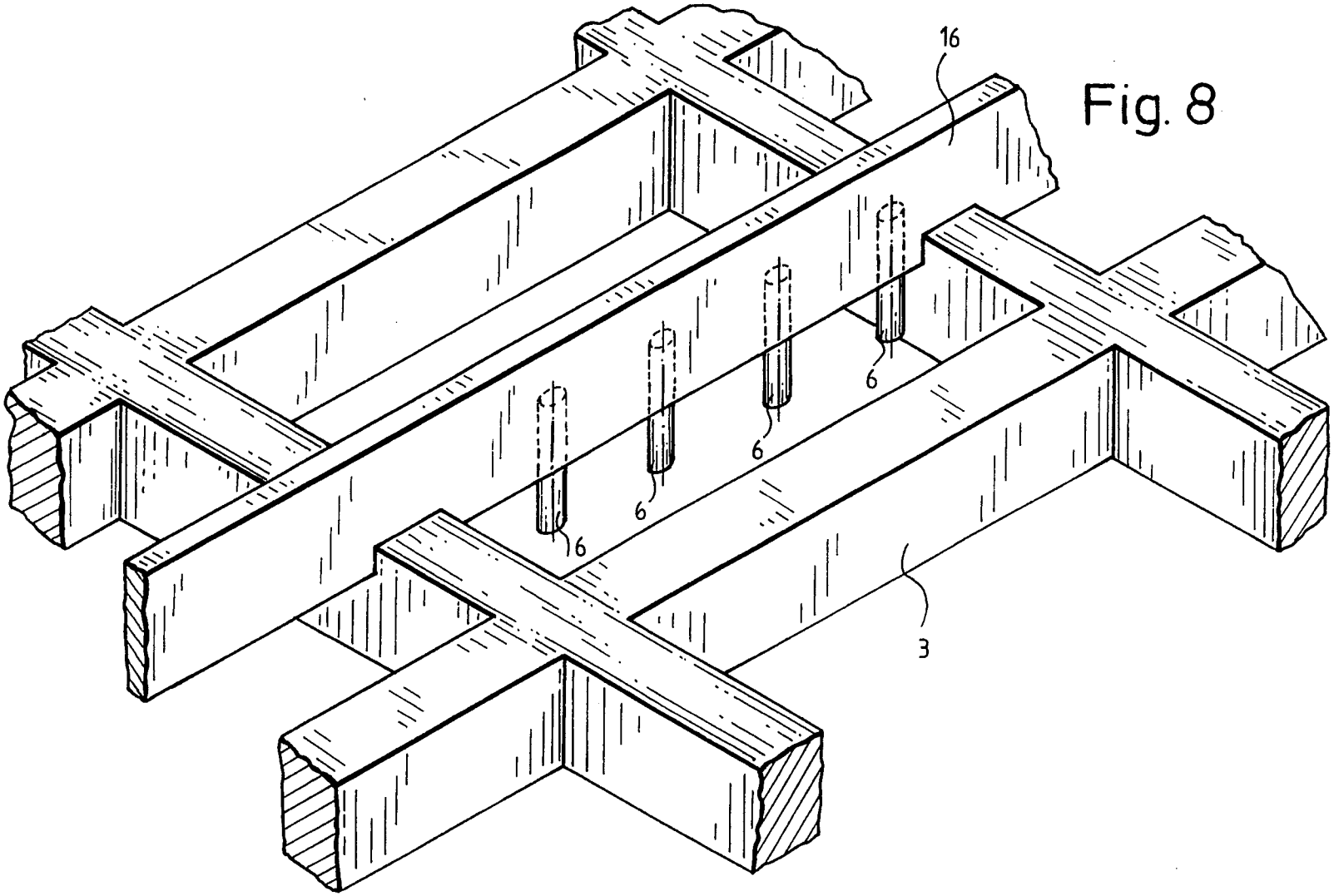
FIG. 8 shows a mold in perspective representation, on which mold a web having core pins is mounted.

As can further be seen from FIG. 8, which shows a perspective view looking downward onto the mold 3, webs 16 can be mounted on the mold 3—only a single web is illustrated in FIG. 8—on which webs the core pins 6 are in turn mounted in such fashion that they extend in the mold 3 as far as the mold table 1 or into the openings 13 of the strips 12. The web width is advantageously adapted to the thickness of the core pins, and the webs are designed in knife-edge form on top, so that plastic concrete can be charged without hindrance. In this case, the male dies are adapted to the free opening cross sections between the webs and the mold, so that adequate compaction of the concrete can take place.

Figures 9, 10:
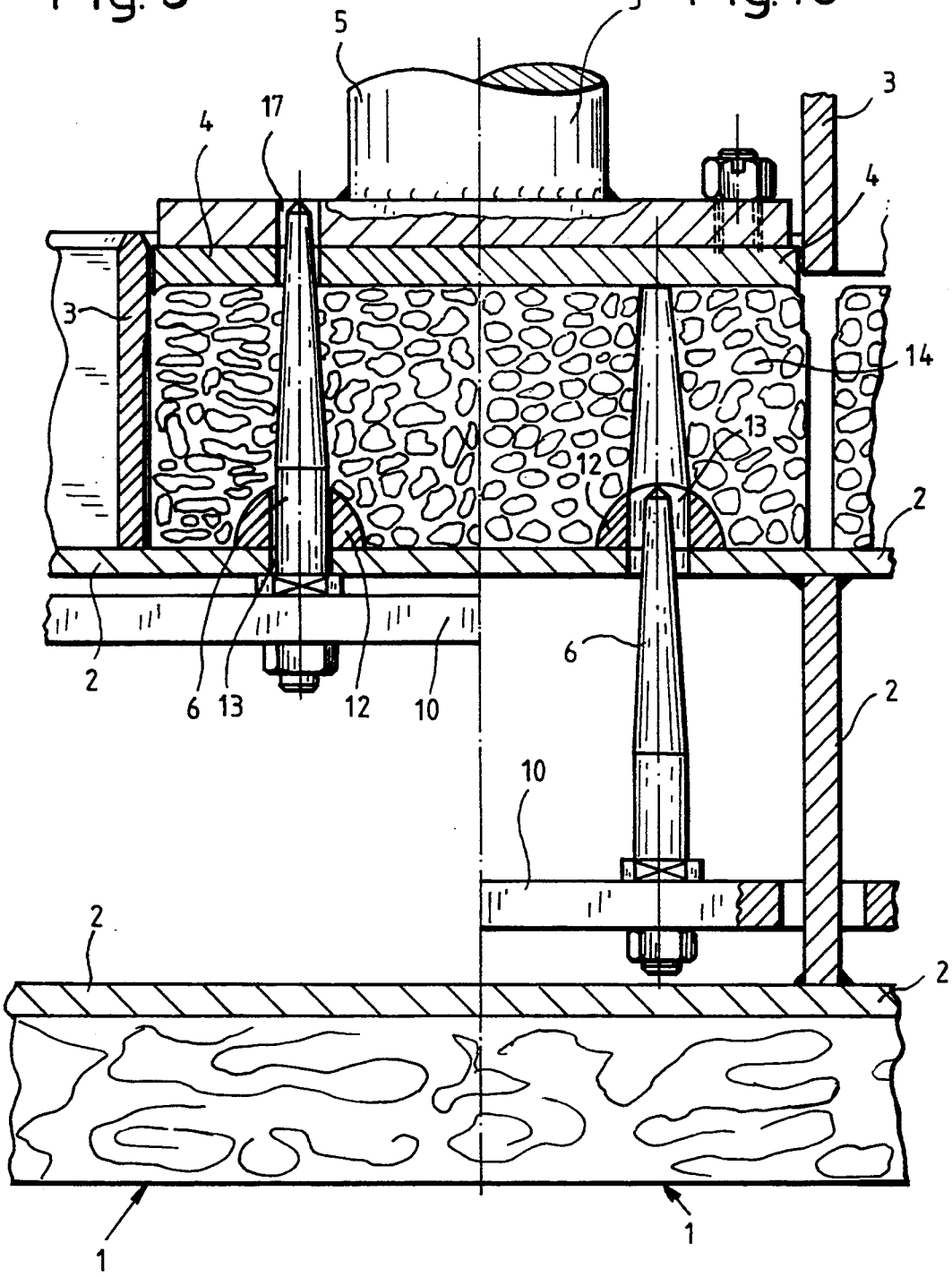
FIG. 9 shows, at an enlarged scale, a device similar to FIG. 6, in which the core pins are mounted on a component that is supported inside a cavity of the drawing sheet, in raised position of the component or of the inserted core pins.
FIG. 10 shows a device corresponding to FIG. 9 in which, however, the component having the core pins is lowered and thus withdrawn from the concrete, and the mold is raised.

In the embodiment of FIGS. 9 and 10, the perforated plate 2 is designed in double-wall fashion so that cavities are produced in which the component 10 having the core pins 6 is mounted in such a way that the core pins can be introduced from below into the mold through the openings 13 in the drawing sheet or in the strips, and indeed introduced far enough that they extend into holes 17 in the male dies 4.

It should be noted that the core pins are guided in the holes 17 in the male dies, in accordance with both the exemplary embodiment of FIGS. 9 and 10 and the exemplary embodiment of FIGS. 1 to 7, in such fashion that no concrete can escape during compaction. If the core pins 6 are designed conical, care should be taken that the sealing is done in such a way that it is effective in sealing over a broad range, but at least when the male dies are compacting the concrete.

Figures 11, 12:
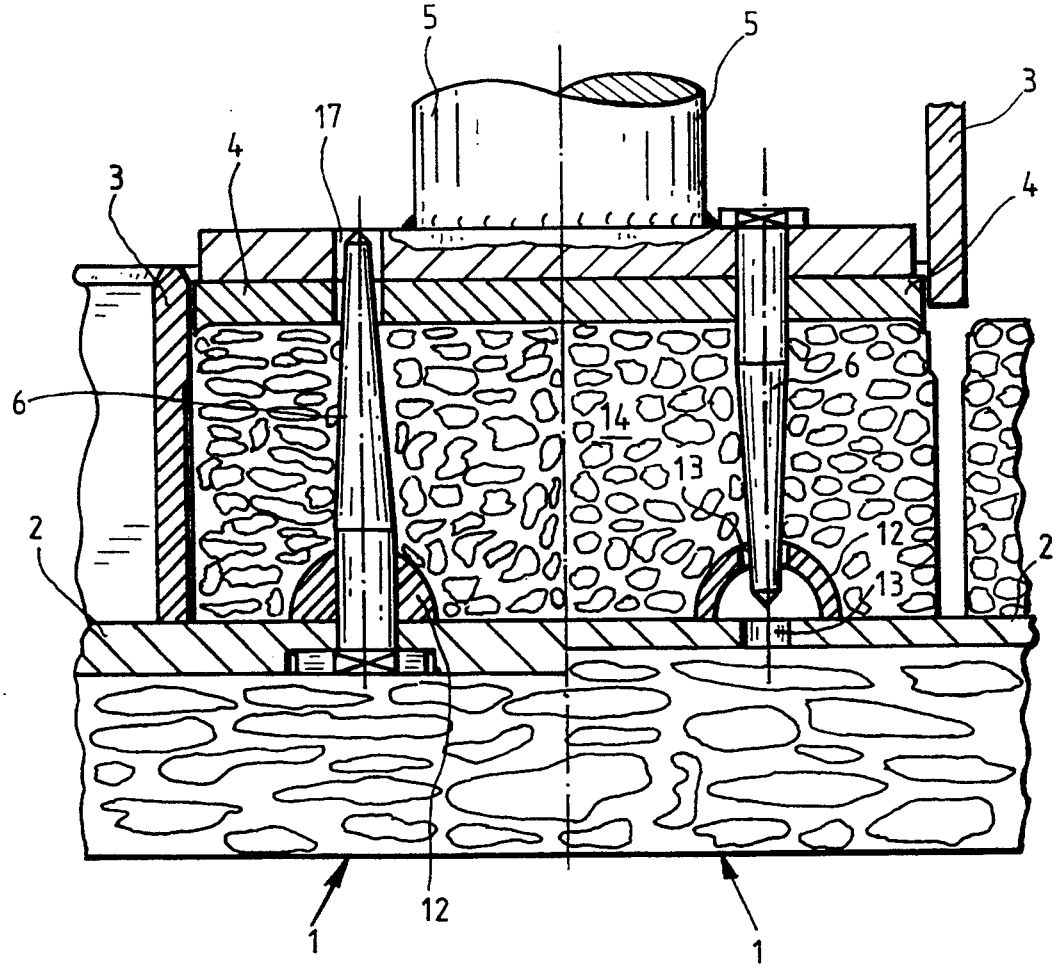
FIG. 11 shows a device similar to FIG. 9 in which, however, the core pins are rigidly mounted on the drawing sheet.
FIG. 12 shows a device similar to FIG. 7 in which, however, the core pins are rigidly mounted on the male dies.

The exemplary embodiments of FIGS. 11 and 12 differ from the embodiments previously described chiefly in that the core pins 6 of FIG. 11 are rigidly bolted to the drawing sheet 2, while in FIG. 12 the core pins 6 are bolted to the male dies 4. The associated process steps are explained in detail in the general description.

What is claimed is:

1. A device for fabrication of perforated concrete blocks, comprising:

a mold table (1) having vertically extending holes therethrough;

a mold (3) supported on top of said mold table (1) for receiving poured concrete to form a concrete block having top, bottom and side surfaces, said mold (3) having top and bottom openings and being elevatable from said mold table (1);

strips (12) on said mold table (1) having openings aligned with said holes in said mold table (1), said strips being positioned within said mold;

a vertically movable male die (4) aligned with said top opening and operable to compact concrete poured into said mold (3) upon its being moved downwardly into said top opening to a compacting position in which it is in downward thrust transmitting engagement with said concrete in said mold and a purality of core pins (6) movable between a retracted position and an inserted position in which said core pins (6) extend through said concrete in said mold (3) and through said openings in said strips (12) to thereby form a plurality of narrow perforations extending between said top and bottom surfaces of said concrete block being formed in said mold (3).

2. The device of claim 1 wherein said male die (4) is insertable through said top opening in said mold (3) and has openings through which said core pins (6) extend in their inserted position.

3. The device of claim 2 wherein said core pins (6) are mounted on a vertically shiftable component (10) positioned above said male die and wherein said component (10) and said mold (3) have vertically confronting abutment surfaces and wherein when said mold (3) is raised from said mold table (1) said abutment surfaces engage to move said core pins (6) to their retracted position.

4. The device of claim 1 wherein said core pins (6) are conically shaped and have a pointed end facilating insertion thereof into poured concrete.

5. The device of claim 3 wherein said mold (3) is movable upwardly while said male die (4) remains in its compacting position, whereby said male die restrains said block during the raising of said mold and the movement of said core pins out of said concrete block to their retracted position.

6. The device of claim 1 wherein said strips (12) are hollow on their underside.

7. A device for fabricating perforated concrete blocks, comprising:

a mold table (1), a mold (3) supported on said mold table (1) for receiving poured concrete to form a concrete block having top, bottom and side surfaces, said mold having top and bottom openings and being elevatable from said mold table to a retracted position to permit removal of said block from said table, a vertically movable male die (4) aligned with and movable from a retracted position downwardly into said top opening of said mold (3) to a compacting position in which it is in downward thrust transmitting engagement with said concrete in said mold, said male die (4) having a plurality of openings extending vertically therethrough, said mold (3) being movable to its retracted position with said male die (4) remaining in its compacting position, a component (10) disposed above and vertically movable relative to said male die, said component (10) having a plurality of vertically extending core pins (6) in registration with said openings in said male die (4), said component (10) being movable, when said male die (4) is in its compacting position, between a retracted position, in which said core pins are retracted from said openings in said male die, and an inserted position in which said core pins extend through said openings in said male die and through said concrete block being formed in said mold to thereby form a plurality of narrow perforations extending between said top and bottom surfaces of said block being formed in said mold and vertically confronting abutment surfaces formed on said component (10) and said mold (3), whereby with said male die remaining in its compacting position, said abutment surfaces engaging to cause said component to be raised to its retracted position when said mold is elevated to its retracted position.

* * * * *